US011326590B2

(12) United States Patent
Claywell et al.

(10) Patent No.: US 11,326,590 B2
(45) Date of Patent: May 10, 2022

(54) METHOD AND APPARATUS FOR CONTROLLING A VARIABLE DISPLACEMENT PUMP

(71) Applicant: GM GLOBAL TECHNOLOGY OPERATIONS LLC, Detroit, MI (US)

(72) Inventors: Mark R. Claywell, Birmingham, MI (US); Alex Cooley, Royal Oak, MI (US); Bryan K. Pryor, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 232 days.

(21) Appl. No.: 16/737,450

(22) Filed: Jan. 8, 2020

(65) Prior Publication Data

US 2021/0207594 A1 Jul. 8, 2021

(51) Int. Cl.
*F04B 49/00* (2006.01)
*F04B 49/08* (2006.01)
(Continued)

(52) U.S. Cl.
CPC ..... *F04B 49/00* (2013.01); *F04B 49/065* (2013.01); *F04B 49/08* (2013.01); *F04B 49/103* (2013.01);
(Continued)

(58) Field of Classification Search
CPC ..... F04B 49/065; F04B 49/08; F04B 49/103; F04B 49/20; F04B 2205/05; F04B 2207/00
See application file for complete search history.

(56) References Cited

U.S. PATENT DOCUMENTS 4,848,790 A * 7/1989 Fukunaga ..... B60G 17/017 280/5.504
8,061,484 B2 * 11/2011 Prior ..... F16N 13/20 184/6.5
(Continued)

OTHER PUBLICATIONS

DE102016123980 (A1): An English language Abstract of the foreign language document is provided herewith, which was obtained from Espacenet (http://worldwide.espacenet.com). Additionally, according to the Bibliographic data available on Espacenet, this foreign language refrence is also published in English, for instance as U.S. Pat. No. 10,066,738B2.
(Continued)

*Primary Examiner* — Christopher S Bobish
(74) *Attorney, Agent, or Firm* — Quinn IP Law

(57) ABSTRACT

A variable displacement pump for supplying fluid to a system is described. Controlling the variable displacement pump is determined based upon inputs from a fluidic pressure sensor and an accelerometer, and includes determining a desired fluidic pressure and monitoring, via the fluidic pressure sensor, an actual fluidic pressure. A pressure error term is determined based upon a difference between the actual fluidic pressure and the desired fluidic pressure. A time-integrated pressure error term is determined based upon the pressure error term, and a g-force is determined based upon an input signal from the accelerometer. The variable displacement pump is controlled in response to the time-integrated pressure error term when the g-force is greater than a threshold g-force.

19 Claims, 4 Drawing Sheets

(51) Int. Cl.

| | |
|---|---|
| ***F04B 49/06*** | (2006.01) |
| ***F04B 49/10*** | (2006.01) |
| ***F04B 49/20*** | (2006.01) |

(52) U.S. Cl.
CPC ..... *F04B 49/20* (2013.01); *F04B 2205/05* (2013.01); *F04B 2207/00* (2013.01)

(56) References Cited

U.S. PATENT DOCUMENTS

| | | | | |
|---|---|---|---|---|
| 10,066,738 | B2 * | 9/2018 | Steele | F16H 57/0443 |
| 10,160,553 | B2 * | 12/2018 | Ward | B64D 37/005 |
| 10,844,854 | B2 * | 11/2020 | Zhang | F04B 49/06 |
| 2009/0238696 | A1 * | 9/2009 | Satake | F16H 61/47 417/34 |
| 2018/0058570 | A1 * | 3/2018 | Osborn | F16H 57/0436 |

OTHER PUBLICATIONS

DE19739750 (A1): An English language Abstract of the foreign language document is provided herewith, which was obtained from Espacenet (http://worldwide.espacenet.com). Additionally, according to the Bibliographic data available on Espacenet, this foreign language refrence is also published in English, for instance as U.S. Pat. No. 5,944,632A DE3942411 (A1): An English language Abstract of the foreign language document is provided herewith, which was obtained from Espacenet (http://worldwide.espacenet.com).

DE4130395 (A1): An English language Abstract of the foreign language document is provided herewith, which was obtained from Espacenet (http://worldwide.espacenet.com). Additionally, according to the Bibliographic data available on Espacenet, this foreign language refrence is also published in English, for instance as U.S. Pat. No. 5,251,929 A.

* cited by examiner

METHOD AND APPARATUS FOR CONTROLLING A VARIABLE DISPLACEMENT PUMP

INTRODUCTION

Internal combustion engines and other on-vehicle devices may employ fluidic pumps to transfer fluid from a sump or other source to moving elements for purposes of lubrication, cooling, etc. One form of a fluidic pump is a variable displacement pump, which may be controlled based upon system demand, thus reducing energy consumption as compared to a fixed displacement pump. System demand may be driven by factors including pressure and volume. When a variable displacement pump is employed to supply fluid to an internal combustion engine, such factors may be based upon engine temperature, engine load and engine speed based upon lubrication needs and/or heat management needs. When a device such as an internal combustion engine is employed on a vehicle, high-g maneuvers and other events may lead to fluidic starvation and air entrapment, which may affect engine performance and durability. There may be a benefit to a system that controls a variable displacement fluidic pump during high-g maneuvers and other events.

SUMMARY

The concepts described herein provide a variable displacement pump for supplying fluid to a system. Controlling the variable displacement pump is determined based upon inputs from a fluidic pressure sensor and an accelerometer, and includes determining a desired fluidic pressure and monitoring, via the fluidic pressure sensor, an actual fluidic pressure. A pressure error term is determined based upon a difference between the actual fluidic pressure and the desired fluidic pressure. A time-integrated pressure error term is determined based upon the pressure error term, and a g-force is determined based upon an input signal from the accelerometer. The variable displacement pump is controlled in response to the time-integrated pressure error term when the g-force is greater than a threshold g-force.

In one embodiment, an internal combustion engine includes a variable displacement pump, a fluidic pressure sensor, an accelerometer, and a controller, wherein the controller is operatively connected to the variable displacement pump, and in communication with the fluidic pressure sensor and the accelerometer. The controller includes an instruction set that is executable to determine a desired fluidic pressure and monitor, via the fluidic pressure sensor, an actual fluidic pressure. A pressure error term is determined based upon a difference between the actual fluidic pressure and the desired fluidic pressure. A time-integrated pressure error term is determined based upon the pressure error term, and a g-force is determined based upon an input signal from the accelerometer. The controller controls the variable displacement pump in response to the time-integrated pressure error term when the g-force is greater than a threshold g-force.

An aspect of the disclosure includes a rotational speed sensor that is arranged to monitor engine speed, wherein the instruction set is executable to control the variable displacement pump responsive to the time-integrated pressure error term when the engine speed is greater than a minimum threshold speed and the g-force is greater than the threshold g-force.

Another aspect of the disclosure includes a magnitude of the desired fluidic pressure being determined based upon the engine speed and the g-force.

Another aspect of the disclosure includes the instruction set being executable to control the variable displacement pump to increase the desired fluidic pressure when the time-integrated pressure error term is greater than a threshold and the g-force is greater than a minimum g-force.

Another aspect of the disclosure includes the instruction set being executable to limit operation of the variable displacement pump to a maximum permissible fluidic pressure term.

Another aspect of the disclosure includes the instruction set being executable to control the variable displacement pump to decrease the desired fluidic pressure when the time-integrated pressure error term is less than a threshold.

Another aspect of the disclosure includes the instruction set being executable to control the variable displacement pump to decrease the desired fluidic pressure when the g-force is less than a minimum g-force.

Another aspect of the disclosure includes a GPS sensor arranged to monitor a geospatial location of the internal combustion engine, wherein the instruction set is executable to control the variable displacement pump responsive to the time-integrated pressure error term and the geospatial location of the internal combustion engine when the g-force is greater than the threshold g-force.

Another aspect of the disclosure includes the magnitude of the desired fluidic pressure being determined based upon the geospatial location of the internal combustion engine.

Another aspect of the disclosure includes the instruction set being executable to determine the desired fluidic pressure by determining a feed-forward fluidic pressure term based upon the engine speed, determining a second fluidic pressure term based upon the geospatial location of the internal combustion engine, and determining the desired fluidic pressure based upon the feed-forward fluidic pressure term, the second fluidic pressure term, and the time-integrated pressure error term.

Another aspect of the disclosure includes the instruction set being executable to determine a maximum permissible fluidic pressure term, and determine the desired fluidic pressure based upon the feed-forward fluidic pressure term, the second fluidic pressure term, and the time-integrated pressure error term and limited to the maximum permissible fluidic pressure term.

Another aspect of the disclosure includes a method for controlling a variable displacement pump, including: determining a desired fluidic pressure; monitoring, via a fluidic pressure sensor, an actual fluidic pressure; determining a pressure error term based upon a difference between the actual fluidic pressure and the desired fluidic pressure; determining a time-integrated pressure error term based upon the pressure error term; determining a g-force based upon an input signal from an accelerometer; and controlling the variable displacement pump responsive to the time-integrated pressure error term when engine speed is greater than a minimum threshold speed and the g-force is greater than the threshold g-force.

Another aspect of the disclosure includes a method for controlling a variable displacement pump arranged to supply pressurized fluid to an on-vehicle system, including: determining a desired fluidic pressure for the system; monitoring, via a pressure sensor, an actual fluidic pressure; determining a pressure error term based upon a difference between the actual fluidic pressure and the desired fluidic pressure; determining a time-integrated pressure error term based upon the pressure error term; determining a g-force based upon an input signal from an accelerometer; and controlling the variable displacement pump responsive to the time-integrated pressure error term when the g-force is greater than a threshold g-force.

Another aspect of the disclosure includes controlling the variable displacement pump responsive to the time-integrated pressure error term when the g-force is greater than a threshold g-force and when the time-integrated pressure error term is negative.

The above summary is not intended to represent every possible embodiment or every aspect of the present disclosure. Rather, the foregoing summary is intended to exemplify some of the novel aspects and features disclosed herein. The above features and advantages, and other features and advantages of the present disclosure, will be readily apparent from the following detailed description of representative embodiments and modes for carrying out the present disclosure when taken in connection with the accompanying drawings and the appended claims.

BRIEF DESCRIPTION OF THE DRAWINGS

One or more embodiments will now be described, by way of example, with reference to the accompanying drawings, in which.

The appended drawings are not necessarily to scale, and may present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. For purposes of convenience and clarity only, directional terms such as top, bottom, left, right, up, over, above, below, beneath, rear, and front, may be used with respect to the drawings. These and similar directional terms are not to be construed to limit the scope of the disclosure. Furthermore, the disclosure, as illustrated and described herein, may be practiced in the absence of an element that is not specifically disclosed herein.

As used herein, the term "system" may refer to mechanical and electrical hardware, sensors, controller, combinatorial logic circuit, and/or other components that provide the described functionality.

Figure 1:
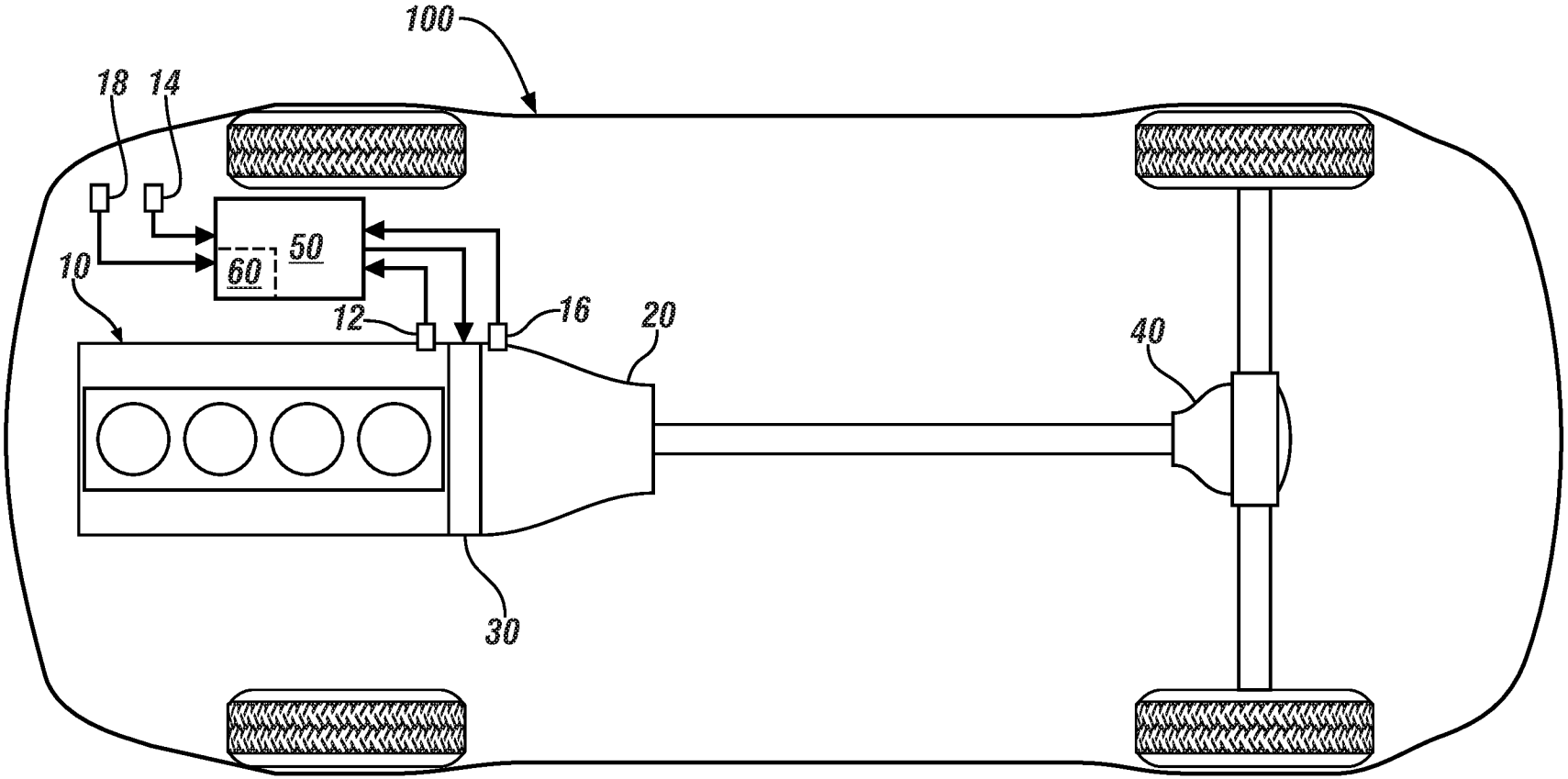
FIG. 1 schematically illustrates a vehicle including a powertrain system including an internal combustion engine and transmission that are coupled to a driveline and controlled by a control system, wherein pressurized lubricant is supplied via a variable displacement pump, in accordance with the disclosure.

Referring now to the drawings, wherein the showings are for the purpose of illustrating certain exemplary embodiments only and not for the purpose of limiting the same, FIG. 1 schematically shows a vehicle 100 including a powertrain system including an internal combustion engine 10 and transmission 20 that are coupled to a driveline 40 and controlled by a controller 50, wherein pressurized lubricant is supplied via a variable displacement pump 30. Like numerals refer to like elements throughout the description. The vehicle may include, but not be limited to a mobile platform in the form of a commercial vehicle, industrial vehicle, agricultural vehicle, passenger vehicle, aircraft, watercraft, train, all-terrain vehicle, personal movement apparatus, robot and the like to accomplish the purposes of this disclosure.

The concepts described herein may apply to a variety of powertrain configurations that employ an embodiment of the variable displacement pump 30 to supply a pressurized fluidic lubricant to an on-vehicle system, of which the internal combustion engine 10 is one example. This may include, by way of non-limiting examples, an embodiment of the variable displacement pump 30 arranged to supply pressurized fluidic lubricant in the form of engine fluid to the internal combustion engine 10, or an embodiment of the variable displacement pump 30 arranged to supply pressurized fluidic lubricant in the form of transmission fluid to the transmission 20, or an embodiment of the variable displacement pump 30 arranged to supply a pressurized fluidic lubricant for purposes of lubrication and/or cooling to an electric machine. Other powertrain configurations that employ an embodiment of the variable displacement pump 30 to supply pressurized fluidic lubricant to on-vehicle system also fall within the scope of this disclosure.

The engine 10 is preferably a multi-cylinder internal combustion engine that converts fuel to mechanical torque through a thermodynamic combustion process. The engine 10 is equipped with a plurality of actuators and sensing devices for monitoring operation and delivering fuel to form in-cylinder combustion charges that generate an expansion force onto pistons that is transferred to a crankshaft to produce torque. Sensors advantageously include a fluidic pressure sensor 12 and an engine speed sensor 16.

The variable displacement pump 30 is configured to control volumetric flowrate in response to operating conditions such as engine speed, engine load, and temperature.

One exemplary transmission 20 is a multi-ratio fixed-gear torque transmission device that is configured to automatically shift gears at predetermined speed/torque shift points, and operate in one of a plurality of selectable fixed-gear ratios that achieves a preferred match between an operator torque request and an engine operating point. The driveline 40 may include a differential gear device that mechanically couples to an axle, transaxle or half-shaft that mechanically couples to a wheel in one embodiment. The driveline 40 transfers tractive power between the transmission 20 and a road surface.

The vehicle 100 includes sensors that are arranged to monitor operating parameters, including an accelerometer 14 that is arranged to monitor lateral and longitudinal acceleration of the vehicle 100, i.e., g-forces. The vehicle 100 also includes, in one embodiment, a global position system (GPS) sensor 18 that is arranged to monitor geospatial location of the vehicle 100.

The controller 50 is configured, in one embodiment, as a hardware device that includes software and other elements, and is arranged to effect operational control of individual elements of the engine 10, the transmission 20, and the variable displacement pump 30. The controller includes an control routine 60 in the form of an instruction set and associated calibrations that is configured to control the variable displacement pump 30 in a manner that is described with reference to FIG. 2.

The terms controller, control module, module, control, control unit, processor and similar terms refer to any one or various combinations of Application Specific Integrated Circuit(s) (ASIC), electronic circuit(s), central processing unit(s), e.g., microprocessor(s) and associated non-transitory memory component in the form of memory and storage devices (read only, programmable read only, random access, hard drive, etc.). The non-transitory memory component is capable of storing machine readable instructions in the form of one or more software or firmware programs or routines, combinational logic circuit(s), input/output circuit(s) and devices, signal conditioning and buffer circuitry and other components that can be accessed by one or more processors to provide a described functionality. Input/output circuit(s) and devices include analog/digital converters and related devices that monitor inputs from sensors, with such inputs monitored at a preset sampling frequency or in response to a triggering event. Software, firmware, programs, instructions, control routines, code, algorithms and similar terms mean any controller-executable instruction sets including calibrations and look-up tables. Each controller executes control routine(s) to provide desired functions, including monitoring inputs from sensing devices and other networked controllers and executing control and diagnostic routines to control operation of actuators. Routines may be executed at regular intervals, for example each 100 microseconds, during ongoing operation. Alternatively, routines may be executed in response to occurrence of a triggering event. Communications between controllers, actuators and/or sensors may be accomplished using a direct wired link, a networked communications bus link, a wireless link, a serial peripheral interface bus or any another suitable communications link. Communications includes exchanging data signals in any suitable form, including, for example, electrical signals via a conductive medium, electromagnetic signals via air, optical signals via optical waveguides, and the like. Data signals may include signals representing inputs from sensors, signals representing actuator commands, and communications signals between controllers. As used herein, the terms 'dynamic' and 'dynamically' describe steps or processes that are executed in real-time and are characterized by monitoring or otherwise determining states of parameters and regularly or periodically updating the states of the parameters during execution of a routine or between iterations of execution of the routine.

Figure 3:
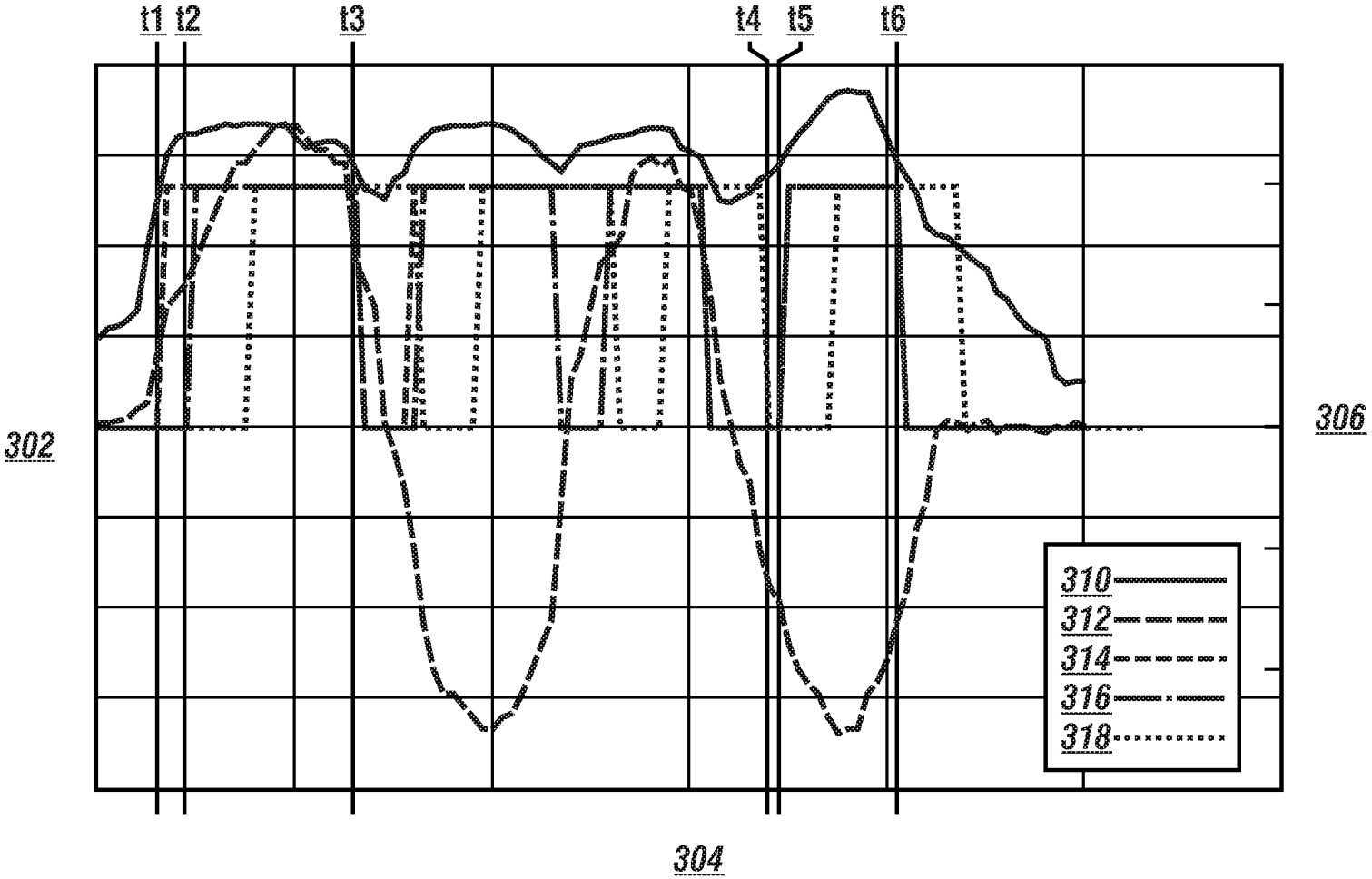
FIG. 3 graphically shows various parameters associated with operation of an embodiment of a vehicle and engine and associated with execution of an embodiment of fluidic pressure control routine for controlling operation of a variable displacement pump, in accordance with the disclosure.
Figure 4:
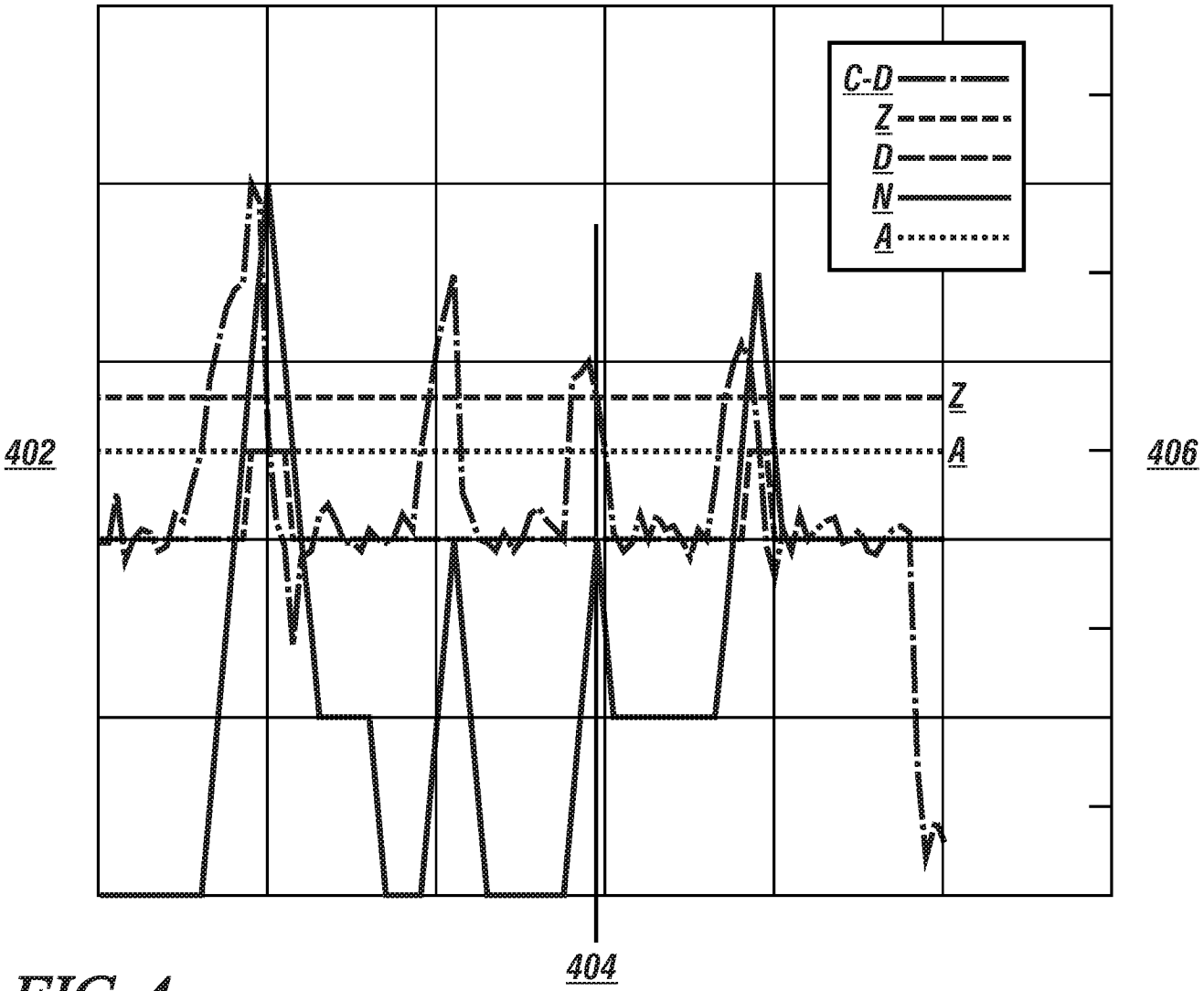
FIG. 4 graphically shows various parameters associated with operation of an embodiment of a vehicle and engine and associated with execution of an embodiment of fluidic pressure control routine for controlling operation of a variable displacement pump, in accordance with the disclosure.

The term "signal" refers to a physically discernible indicator that conveys information, and may be a suitable waveform (e.g., electrical, optical, magnetic, mechanical or electromagnetic), such as DC, AC, sinusoidal-wave, triangular-wave, square-wave, vibration, and the like, that is capable of traveling through a medium. A parameter is defined as a measurable quantity that represents a physical property of a device or other element that is discernible using one or more sensors and/or a physical model. A parameter can have a discrete value, e.g., either "1" or "0", or can be infinitely variable in value. The terms "calibration", "calibrated", and related terms refer to a result or a process that correlates a desired parameter and one or multiple perceived or observed parameters for a device or a system. A calibration as described herein may be reduced to a storable parametric table, a plurality of executable equations or another suitable form that may be employed as part of a measurement or control routine. For example, the threshold terms mentioned and described with reference to FIGS. 2, 3, and 4 are calibrated terms that may be determined based upon physics and/or empirical observations.

The concepts described herein provide for controlling an embodiment of the variable displacement pump 30 to supply pressurized fluid to an on-vehicle system, including during high-g maneuvers, in a manner that is intended to prevent fluidic starvation to the on-vehicle system. This includes determining a desired fluidic pressure for the on-vehicle system, and monitoring, via a pressure sensor, an actual fluidic pressure. A pressure error term is determined based upon a difference between the actual fluidic pressure and the desired fluidic pressure, and a time-integrated pressure error term is determined based upon the pressure error term. The pressure error term and the time-integrated pressure error term are monitored to detect occurrence of a fluidic starvation state. A lateral and/or longitudinal g-force is determined based upon an input signal from an accelerometer, and the variable displacement pump is controlled responsive to the time-integrated pressure error term when the g-force is greater than a threshold g-force. The concepts further include, monitoring, via a speed sensor, a rotational speed of the on-vehicle system, and controlling the variable displacement pump responsive to the time-integrated pressure error term when the rotational speed is greater than a minimum threshold speed and the g-force is greater than the threshold g-force. The concepts further include monitoring, via a GPS sensor, a geospatial position of on-vehicle system, and controlling the variable displacement pump responsive to the time-integrated pressure error term and the geospatial position of the on-vehicle system when the rotational speed is greater than the minimum threshold speed and the g-force is greater than the threshold g-force. The variable displacement pump is controlled in a manner that is responsive to the time-integrated pressure error term when the g-force is greater than a threshold g-force and when the time-integrated pressure error term indicates a fluidic starvation state. These concepts are now described with reference to FIGS. 2, 3 and 4.

Figure 2:
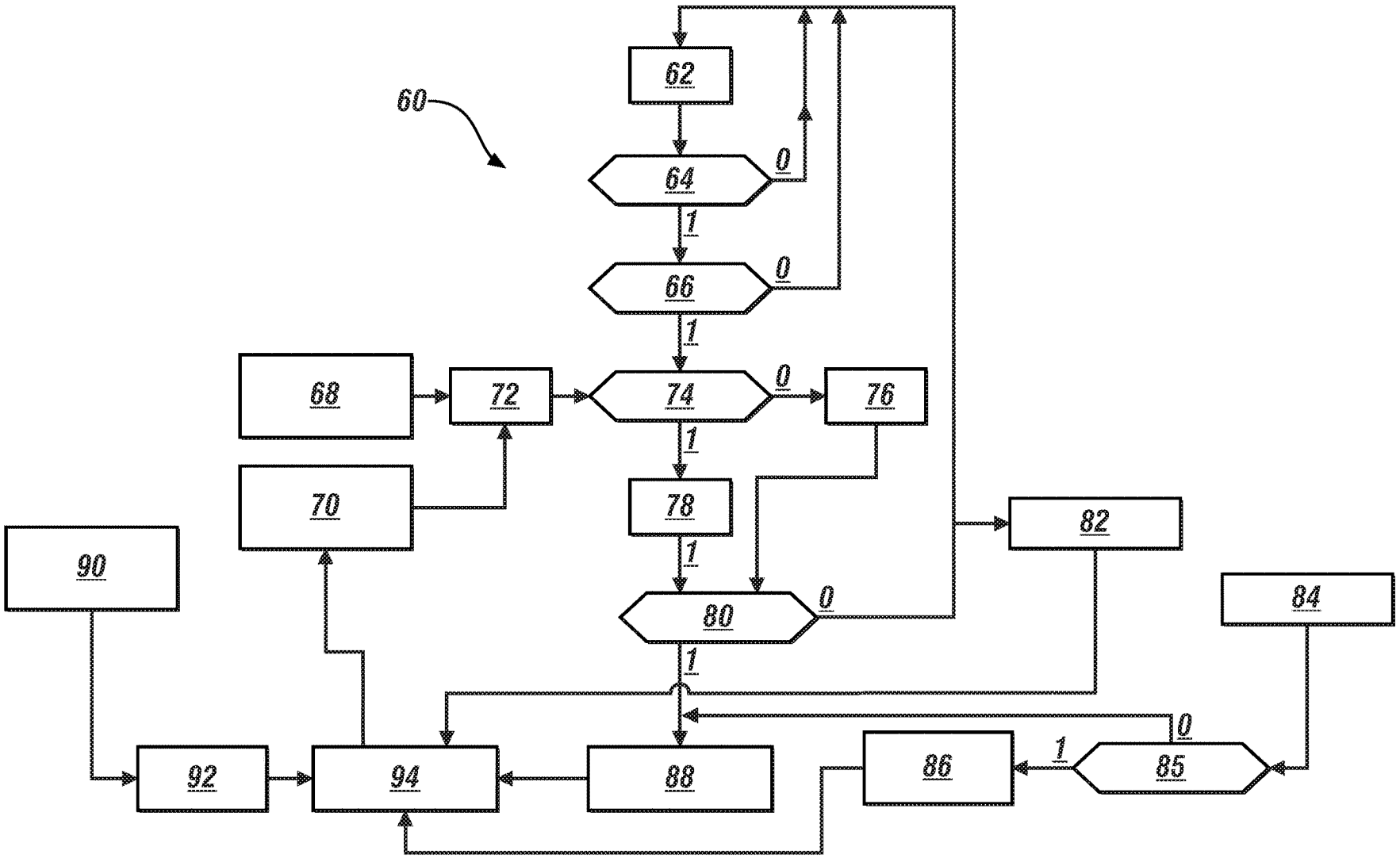
FIG. 2 schematically illustrates a fluidic pressure control routine for controlling operation of a variable displacement pump, in accordance with the disclosure.

FIG. 2 schematically illustrates a fluidic pressure control routine (control routine) 60 for controlling operation of an embodiment of the variable displacement pump 30 that is described with reference to FIG. 1, which may be described in context of an embodiment of the vehicle 100 that is described with reference to FIG. 1. The control routine 60 is illustrated as a collection of blocks in a logical flow graph, which represents a sequence of operations that can be implemented in hardware, software, or a combination thereof. In the context of software, the blocks represent computer instructions that, when executed by one or more processors, perform the recited operations. For convenience and clarity of illustration, the control routine 60 is described with reference to the vehicle 100 shown in FIG. 1. Table 1 is provided as a key wherein the numerically labeled blocks and the corresponding functions are set forth as follows, corresponding to the control routine 60.

TABLE 1

| BLOCK | BLOCK CONTENTS |
|---|---|
| 62 | Monitor engine speed (RPM), vehicle g-forces, GPS sensor |
| 64 | RPM > threshold RPM? |
| 66 | g-forces > threshold g-forces? |
| 68 | Monitor fluidic pressure C |
| 70 | Determine desired fluidic pressure D |
| 72 | Determine fluidic pressure error C − D |
| 74 | Evaluate fluidic pressure error<br>Is fluidic pressure error > threshold error Z? |
| 76 | Decrement pressure error counter N |
| 78 | Increment pressure error counter N |
| 80 | Is pressure error counter N > threshold A? |
| 82 | Determine fluidic pressure decrement term |
| 84 | Monitor GPS sensor |
| 85 | GPS indicates off-road condition, or other extreme condition |
| 86 | Determine off-road fluidic pressure increment term |
| 88 | Determine fluidic pressure increment term |
| 90 | Feed-forward fluidic pressure |
| 92 | Determine feed-forward fluidic pressure increment term based upon RPM, g-force |
| 94 | Combine terms to set the desired fluidic pressure D, subject to a maximum permissible fluidic pressure term |

The control routine 60 periodically executes as follows with an execution rate being selected based upon factors related to update rates from the various sensors, etc. The steps of the control routine 60 may be executed in a suitable order, and are not limited to the order described with reference to FIG. 2. As employed herein, the term "1" indicates an answer in the affirmative, or "YES", and the term "0" indicates an answer in the negative, or "NO". Each iteration, inputs from the engine speed sensor 16 and the accelerometer 14 are monitored (62), along with inputs from the fluidic pressure sensor 12, i.e., an actual fluidic pressure (68), and the GPS sensor 18 (84). When the engine speed (RPM) is less than a threshold engine speed (64)(0), or the g-force is less than a threshold g-force (66)(0), the iteration ends without further action and the variable displacement pump 30 is controlled in response to a nominal control rate.

Coincidently, the actual fluidic pressure that is input from the fluidic pressure sensor 12 C (68) is compared with a desired fluidic pressure D (70) to determine a pressure error term (C-D), which may have either a negative value indicating a fluidic starvation state, or a positive value (72). Determination of the desired fluidic pressure D (70) is described herein. When the engine speed (RPM) is greater than the threshold engine speed (64)(1), and the g-force is greater than the threshold g-force (66)(1), the pressure error term C-D is compared to an error threshold Z (74).

When the pressure error term C-D exceeds the error threshold Z (74)(1), a pressure error counter N is incremented (78). The pressure error counter N is one embodiment of a time-integrated pressure error term that is employed to monitor, over time, consecutive occurrence(s) of the pressure error term C-D being greater than the error threshold Z, which indicates likelihood of fluidic starvation in the on-vehicle system that is being monitored, e.g., the engine 10. Alternatively, the pressure error term C-D may be time-integrated, or subjected to a moving average calculation, to evaluate the likelihood of fluidic starvation in the on-vehicle system. When the pressure error term C-D is less than the error threshold Z (74), the pressure error counter N is decremented (76).

The pressure error counter N is compared to a threshold term A (80). When the pressure error counter N is greater than the threshold term A (80)(1), a fluidic pressure increment term is determined (88), and provided to step 94. When the pressure error counter N is less than the threshold term A (80)(0), a fluidic pressure decrement term is determined (82), and provided to step 94.

The input from the GPS sensor 18 is monitored to determine a geospatial location for the vehicle 100 including the on-vehicle system (84). When the geospatial location for the vehicle 100 indicates that the vehicle 100 is operating in an off-highway location (85)(1), a second fluidic pressure term in the form of an off-road fluidic pressure increment term is determined (86), and provided to step 94.

When the geospatial location for the vehicle 100 indicates that the vehicle 100 is operating in an on-highway location (85)(0), no further action occurs with regard to the geospatial term.

A feed-forward fluidic pressure term is determined based upon prior experience with operation of the engine 10 at the present engine speed and load (90), which includes determining a feed-forward fluidic pressure increment term (92) based upon prior operating conditions and demands for the engine 10.

The feed-forward fluidic pressure increment term, the off-road fluidic pressure increment term (if any), the fluidic pressure decrement term (if any), and the fluidic pressure increment term (if any) are combined to determine a demand fluidic pressure term, which is subjected to a maximum permissible fluidic pressure term (94). A minimum value of the demand fluidic pressure term and the maximum permissible fluidic pressure term is communicated and employed as the desired fluid pressure term D during the next iteration of the routine (70).

In this manner, the control routine 60 controls operation of the variable displacement pump 30 to supply pressurized fluid to the on-vehicle system during high-g maneuvers to prevent fluidic starvation to the on-vehicle system, while not interfering with the operation of the variable displacement pump 30 under nominal situations. This enables operation to take advantage of reduced energy consumption features of the variable displacement pump 30.

FIG. 3 graphically shows various parameters associated with operation of an embodiment of the vehicle 100 and engine 10 that is described with reference to FIG. 1, wherein the parameters are associated with execution of the control routine 60 that is described with reference to FIG. 2. The axes include vertical axes of engine speed 302 and g-force 306, and horizontal axis of time 304, and the plotted parameters include engine speed 310, g-force 312, engine speed enable flag 314, g-force enable flag 316, and a fluidic pressure increment enable term 318. Initially, the engine speed 310 and the g-force 312 are less than respective thresholds. At time t1, the engine speed 310 exceeds the threshold engine speed 314, triggering the engine speed enable flag 314, and at time t2, the g-force 312 exceeds a positive threshold g-force, triggering the g-force enable flag 316. At time t2, operation of steps 72 through 94 of the control routine 60 are enabled to set the desired fluidic pressure, subject to a maximum permissible fluidic pressure term to eliminate or minimize likelihood that fluidic starvation occurs. This operation continues until time t3, at which point the g-force 312 and the engine speed 310 fall below respective thresholds, and operation of steps 72 through 94 of the control routine 60 is disabled. In a similar manner, at time t4, the g-force 312 is less than a negative threshold g-force, triggering the g-force enable flag 316, and at time t5, the engine speed 310 exceeds the threshold engine speed 314, triggering the engine speed enable flag 314. At time t5, operation of steps 72 through 94 of the control routine 60 are enabled to set the desired fluidic pressure, subject to a maximum permissible fluidic pressure term to eliminate or minimize likelihood that fluidic starvation occurs. This operation continues until time t6, at which point the g-force 312 and the engine speed 310 fall below respective thresholds, and operation of steps 72 through 94 of the control routine 60 is disabled.

FIG. 4 graphically shows details related to other parameters associated with operation of an embodiment of the vehicle 100 and engine 10 that is described with reference to FIG. 1, wherein the parameters are associated with execution of the control routine 60 that is described with reference to FIG. 2. The axes include vertical axes of engine oil pressure 402 and counts 406, in relation to time 404, which is on the horizontal axis. The plotted parameters include the fluidic pressure error term C-D, the fluidic pressure threshold term Z, the desired fluid pressure term D, pressure error counter N, and counter threshold A. After the enable criteria are met (Steps 62, 64, 66 of FIG. 2), the fluidic pressure error term C-D is determined (Step 72 of FIG. 2) and compared to the fluidic pressure threshold term Z (Step 74 of FIG. 2), and pressure error counter N is either incremented (Step 78 of FIG. 2) or decremented (Step 76 of FIG. 2). The counter N is compared to the counter threshold A (Step 80 of FIG. 2). When the pressure error counter N is greater than the counter threshold A, a fluidic pressure increment term is determined (Step 88 of FIG. 2), and employed to determine the desired fluid pressure term D, subject to a maximum permissible fluidic pressure term (Step 94 of FIG. 2). When the pressure error counter N is less than the counter threshold A, a fluidic pressure decrement term is determined (Step 82 of FIG. 2), and employed to determine the desired fluid pressure term D, subject to the maximum permissible fluidic pressure term (Step 94 of FIG. 2).

The system described herein operates to take measures to protect the on-vehicle system, e.g., the internal combustion engine, while not interfering with the operation of the variable displacement pump 30 in nominal situations, so as to take advantage of reduced energy consumption features of the variable displacement pump 30. The concepts also include an algorithm to control fluidic pressure based on a vehicle operation history in extreme maneuvers. A fluidic pressure error term, which is defined by the difference between actual fluidic pressure and desired fluidic pressure, is employed as a surrogate for fluid starvation. The intent is to use various inputs to ignore smaller pressure errors, but once they are over a certain limit or happening under high performance driving conditions, those errors are added to the fluidic pressure target. Over time that fluidic pressure target is allowed to come back to the baseline calibrated value.

The flowchart and block diagrams in the flow diagrams illustrate the architecture, functionality, and operation of possible implementations of systems, methods, and computer program products according to various embodiments of the present disclosure. In this regard, each block in the flowchart or block diagrams may represent a module, segment, or portion of code, which comprises one or more executable instructions for implementing the specified logical function(s). It will also be noted that each block of the block diagrams and/or flowchart illustrations, and combinations of blocks in the block diagrams and/or flowchart illustrations, may be implemented by dedicated-function hardware-based systems that perform the specified functions or acts, or combinations of dedicated-function hardware and computer instructions. These computer program instructions may also be stored in a computer-readable medium that can direct a computer or other programmable data processing apparatus to function in a particular manner, such that the instructions stored in the computer-readable medium produce an article of manufacture including instruction set that implements the function/act specified in the flowchart and/or block diagram block or blocks.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

What is claimed is:

1. An internal combustion engine, comprising:

a variable displacement pump, a fluidic pressure sensor, an accelerometer, and a controller;

wherein the controller is operatively connected to the variable displacement pump, and is in communication with the fluidic pressure sensor and the accelerometer; and wherein the controller includes an instruction set, the instruction set being executable to:

determine a desired fluidic pressure;

monitor, via the fluidic pressure sensor, an actual fluidic pressure;

determine a pressure error term based upon a difference between the actual fluidic pressure and the desired fluidic pressure;

determine a time-integrated pressure error term based upon the pressure error term;

determine a g-force based upon an input signal from the accelerometer; and control the variable displacement pump responsive to the time-integrated pressure error term when the g-force is greater than a threshold g-force.

2. The internal combustion engine of claim 1, further comprising the instruction set being executable to control the variable displacement pump to increase the desired fluidic pressure when the time-integrated pressure error term is greater than a threshold when the g-force is greater than the threshold g-force.

3. The internal combustion engine of claim 2, wherein the instruction set is executable to limit operation of the variable displacement pump to a maximum permissible fluidic pressure term.

4. The internal combustion engine of claim 2, further comprising the instruction set being executable to control the variable displacement pump to decrease the desired fluidic pressure when the time-integrated pressure error term is less than a threshold indicating a fluidic starvation state.

5. The internal combustion engine of claim 2, further comprising the instruction set being executable to control the variable displacement pump to decrease the desired fluidic pressure when the g-force is less than the threshold g-force.

6. The internal combustion engine of claim 1, further comprising a rotational speed sensor arranged to monitor engine speed; wherein the instruction set is executable to control the variable displacement pump responsive to the time-integrated pressure error term when the engine speed is greater than a minimum threshold speed and the g-force is greater than the threshold g-force.

7. The internal combustion engine of claim 6, wherein a magnitude of the desired fluidic pressure is determined based upon the engine speed and the g-force.

8. The internal combustion engine of claim 1, further comprising a GPS sensor arranged to monitor a geospatial location of the internal combustion engine;

wherein the instruction set is executable to control the variable displacement pump responsive to the time-integrated pressure error term and the geospatial location of the internal combustion engine when the g-force is greater than the threshold g-force.

9. The internal combustion engine of claim 8, wherein the magnitude of the desired fluidic pressure is determined based upon the geospatial location of the internal combustion engine.

10. The internal combustion engine of claim 8, further comprising a rotational speed sensor arranged to monitor engine speed; wherein the instruction set being executable to determine the desired fluidic pressure comprises the instruction set being executable to:

determine a feed-forward fluidic pressure term based upon the engine speed;

determine a second fluidic pressure term based upon the geospatial location of the internal combustion engine; and determine the desired fluidic pressure based upon the feed-forward fluidic pressure term, the second fluidic pressure term, and the time-integrated pressure error term.

11. The internal combustion engine of claim 10, further comprising the instruction set being executable to determine a maximum permissible fluidic pressure term, and determine the desired fluidic pressure based upon the feed-forward fluidic pressure term, the second fluidic pressure term, and the time-integrated pressure error term and limited to the maximum permissible fluidic pressure term.

12. A method for controlling a variable displacement pump arranged to supply fluid to an internal combustion engine, the method comprising:

determining a desired fluidic pressure;

monitoring, via a fluidic pressure sensor, an actual fluidic pressure;

determining a pressure error term based upon a difference between the actual fluidic pressure and the desired fluidic pressure;

determining a time-integrated pressure error term based upon the pressure error term;

determining a g-force based upon an input signal from an accelerometer; and controlling the variable displacement pump responsive to the time-integrated pressure error term when the g-force is greater than a threshold g-force.

13. The method of claim 12, further comprising monitoring, via a rotational speed sensor, rotational speed of the internal combustion engine; and controlling the variable displacement pump responsive to the time-integrated pressure error term when the engine speed is greater than a minimum threshold speed and the g-force is greater than the threshold g-force.

14. The method of claim 13, further comprising controlling the variable displacement pump to increase the desired fluidic pressure when the rotational speed of the internal combustion engine is greater than the minimum threshold speed and the g-force is greater than the threshold g-force, and controlling the variable displacement pump to decrease the desired fluidic pressure when the rotational speed of the internal combustion engine is less than the minimum threshold speed or when the g-force is less than the threshold g-force.

15. The method of claim 13, further comprising monitoring, via a GPS sensor, a geospatial position of the internal combustion engine; and controlling the variable displacement pump responsive to the time-integrated pressure error term and the geospatial position of the internal combustion engine when the rotational speed of the internal combustion engine is greater than the minimum threshold speed, the g-force is greater than the threshold g-force.

16. A method for controlling a variable displacement pump arranged to supply pressurized fluid to an on-vehicle system, the method comprising:

determining a desired fluidic pressure for the system;

monitoring, via a pressure sensor, an actual fluidic pressure;

determining a pressure error term based upon a difference between the actual fluidic pressure and the desired fluidic pressure;

determining a time-integrated pressure error term based upon the pressure error term;

determine a g-force based upon an input signal from an accelerometer; and controlling the variable displacement pump responsive to the time-integrated pressure error term when the g-force is greater than a threshold g-force.

17. The method of claim 16, further comprising:

monitoring, via a speed sensor, a rotational speed of the on-vehicle system; and controlling the variable displacement pump responsive to the time-integrated pressure error term when the rotational speed is greater than a minimum threshold speed and the g-force is greater than the threshold g-force.

18. The method of claim 17, further comprising monitoring, via a GPS sensor, a geospatial position of the on-vehicle system; and controlling the variable displacement pump responsive to the time-integrated pressure error term and the geospatial position of the on-vehicle system when the rotational speed is greater than the minimum threshold speed and the g-force is greater than the threshold g-force.

19. The method of claim 17, further comprising controlling the variable displacement pump responsive to the time-integrated pressure error term when the g-force is greater than a threshold g-force and when the time-integrated pressure error term indicates a fluidic starvation state.

* * * * *